US007509088B2

(12) United States Patent
Miyake

(10) Patent No.: US 7,509,088 B2
(45) Date of Patent: Mar. 24, 2009

(54) SHEET REVERSE CONVEYANCE DEVICE AND IMAGE FORMING APPARATUS HAVING SUCH A DEVICE

(75) Inventor: Toshiyuki Miyake, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 337 days.

(21) Appl. No.: 11/411,936

(22) Filed: Apr. 27, 2006

(65) Prior Publication Data

US 2006/0251453 A1 Nov. 9, 2006

(30) Foreign Application Priority Data

May 6, 2005 (JP) ..... 2005-135304

(51) Int. Cl.
*G03G 15/00* (2006.01)

(52) U.S. Cl. ..... 399/401; 399/405; 399/407

(58) Field of Classification Search ..... 271/902, 271/186, 184, 185; 399/401, 405
See application file for complete search history.

(56) References Cited

U.S. PATENT DOCUMENTS 6,445,903 B2 * 9/2002 Hashimoto et al. ..... 399/401

FOREIGN PATENT DOCUMENTS

JP 8-59046 3/1996

JP 11-236157 8/1999

OTHER PUBLICATIONS

JP 06271166 machine translation.*

* cited by examiner

*Primary Examiner*—Daniel J Colilla
*Assistant Examiner*—Allister Primo
(74) *Attorney, Agent, or Firm*—Fitzpatrick, Cella, Harper & Scinto

(57) ABSTRACT

A sheet reverse conveyance device has a control part which controls so that the forward conveyance rotation member pair is set into a contact condition and the reverse conveyance rotation member pair is set into a detachment condition until a rear edge of the sheet which has entered the reverse conveyance path and is conveyed by the forward conveyance rotation member pair passes through an entrance of the discharge path, and in order to convey the sheet to the discharge path by the reverse conveyance rotation member pair, the forward conveyance rotation member pair is set into the detachment condition and the reverse conveyance rotation member pair is set into the contact condition after the rear edge of the sheet conveyed by the forward conveyance rotation member pair passed through the entrance of the discharge path.

7 Claims, 11 Drawing Sheets

SHEET REVERSE CONVEYANCE DEVICE AND IMAGE FORMING APPARATUS HAVING SUCH A DEVICE

BACKGROUND OF THE INVENTION

1. Field of the Invention

The invention relates to a sheet reverse conveyance device for executing a reversing operation of a sheet which is being conveyed and an image forming apparatus having such a sheet reverse conveyance device.

2. Related Background Art

Hitherto, as a sheet handling apparatus for handling a sheet, there is an image forming apparatus for forming an image onto the sheet, a document feeder for automatically feeding a document to an image reading part which is provided for the image forming apparatus and reads the document of the image forming apparatus, a sheet processor for processing the sheet on which the image has been formed by the image forming apparatus, or the like.

As an image forming apparatus, there is a copying apparatus, a laser beam printer, a facsimile apparatus, a multifunction apparatus of them, or the like. As a sheet processor, there is a stapler for stapling the sheet, a punching device for punching a hole, a folding device for folding the sheet, or the like.

In the sheet handling apparatus, there is a case where front and back sides of the sheet have to be reversed. Generally, in many cases, the image forming apparatus as a sheet handling apparatus discharges the sheet in the state where the image forming surface formed on the sheet is set to be upward (face-up). In such a case, when a document of a plurality of pages is copied, the subsequent sheet is discharged onto the precedent sheet in the state where the image forming surface is set to face-up, so that page order is reversed. Therefore, generally, in many cases, the image forming apparatus has a sheet reverse conveyance device which enables the sheet whose image forming surface is in the face-up state to be discharged in the state where the image forming surface is set to be downward (face-down). In many cases, the image forming apparatus has the sheet reverse conveyance device in order to form images onto both sides of the sheet.

As such an image forming apparatus having the sheet reverse conveyance device, there is an image forming apparatus disclosed in Japanese Patent Application Laid-open No. H08-059046.

In the sheet reverse conveyance device disclosed in Japanese Patent Application Laid-open No. H08-059046, a pair of conveyance rollers which can touch and detach are provided in an entrance portion of a reverse conveyance path. The sheet reverse conveyance device is constructed in such a manner that while the precedent sheet is being conveyed from the reverse conveyance path by a pair of discharging rollers, when the subsequent sheet is conveyed into the entrance of the reverse conveyance path, the pair of conveyance rollers are detached so that the sheets pass each other, thereby allowing the subsequent sheet to enter the reverse conveyance path while discharging the precedent sheet from the reverse conveyance path by the pair of discharging rollers.

However, according to the sheet reverse conveyance device disclosed in Japanese Patent Application Laid-open No. H08-059046, the pair of conveyance rollers for reversing the sheet conveyed into the reverse conveyance path are driven by a driving motor which can be forwardly and reversely rotated. After the sheet is conveyed in the reverse conveyance path by a predetermined amount, the rotation of the pair of conveyance rollers is decelerated and stopped and, subsequently, the pair of conveyance rollers are rotated in the opposite direction. The driving motor is also switched from the forward rotation to the reverse rotation in order to reversely rotate the pair of conveyance rollers. A predetermined stop time is required when the rotation of the driving motor is switched from the forward rotation to the reverse rotation. Therefore, the sheet reverse conveyance device disclosed in Japanese Patent Application Laid-open No. H08-059046 has a problem that the reversing operation of the sheet cannot be promptly executed.

According to Japanese Patent Application Laid-open No. H11-236157, a reverse driving roller 69 for reversing the conveying direction of a sheet and conveying the sheet is provided on a path for reversing the sheet. A reverse driven roller 68 for moving the sheet to a position where it is sandwiched between the reverse driven roller 68 and the reverse driving roller 69 and a position where it is on standby from the reverse driving roller 69 is provided. The sheet is conveyed between a reversing roller 67 and a reverse branch claw which has been come into pressure contact therewith and is conveyed into the path for reversing the sheet. Therefore, it is difficult to convey the sheet at a high speed and certainly convey the sheet into the path for reversing the sheet.

SUMMARY OF THE INVENTION

In consideration of the above problem, it is an object of the invention to provide a sheet reverse conveyance device which can execute the reversing operation of a sheet at a higher speed.

Another object of the invention is to provide a sheet reverse conveyance device which can shorten a time that is required to reverse the sheet.

Still another object of the invention is to provide a sheet reverse conveyance device for temporarily conveying a sheet which has entered a reverse conveyance path from an entry path into the reverse conveyance path, thereafter, conveying the sheet to a discharge path, and reversing the sheet, comprising: a pair of forward conveyance rotation members which are provided on the reverse conveyance path, rotate in such a direction as to convey the sheet into the reverse conveyance path, and can touch and detach; a pair of reverse conveyance rotation members which are provided on the reverse conveyance path, rotate in the direction opposite to the rotating direction of the pair of forward conveyance rotation members in order to convey the sheet conveyed into the reverse conveyance path by the pair of forward conveyance rotation members to the discharge path, and can touch and detach; and a control part adapted to control the touch/detach operations of the pair of forward conveyance rotation members and the pair of reverse conveyance rotation members, wherein the control part controls in such a manner that the pair of forward conveyance rotation members are set into a contact condition and the pair of reverse conveyance rotation members are set into a detachment condition until a rear edge of the sheet which has entered the reverse conveyance path and is conveyed by the pair of forward conveyance rotation members passes through an entrance of the discharge path, and in order to convey the sheet to the discharge path by the pair of reverse conveyance rotation members, the pair of forward conveyance rotation members are set into the detachment condition and the pair of reverse conveyance rotation members are set into the contact condition after the rear edge of the sheet conveyed by the pair of forward conveyance rotation members passed through the entrance of the discharge path.

Further another object of the invention is to provide an image forming apparatus comprising an image forming part adapted to form an image onto a sheet and a sheet reverse conveyance device, wherein the sheet reverse conveyance device temporarily conveys the sheet which has entered a reverse conveyance path from an entry path into the reverse conveyance path, thereafter, conveys the sheet to a discharge path, and reverses the sheet, the sheet reverse conveyance device has: a pair of forward conveyance rotation members which are provided on the reverse conveyance path, rotate in such a direction as to convey the sheet into the reverse conveyance path, and can touch and detach; a pair of reverse conveyance rotation members which are provided on the reverse conveyance path, rotate in the direction opposite to the rotating direction of the pair of forward conveyance rotation members in order to convey the sheet conveyed into the reverse conveyance path by the pair of forward conveyance rotation members to the discharge path, and can touch and detach; and a control part adapted to control the touch/detach operations of the pair of forward conveyance rotation members and the pair of reverse conveyance rotation members, the control part controls in such a manner that the pair of forward conveyance rotation members are set into a contact condition and the pair of reverse conveyance rotation members are set into a detachment condition until a rear edge of the sheet which has entered the reverse conveyance path and is conveyed by the pair of forward conveyance rotation members passes through an entrance of the discharge path, and in order to convey the sheet to the discharge path by the pair of reverse conveyance rotation members, the pair of forward conveyance rotation members are set into the detachment condition and the pair of reverse conveyance rotation members are set into the contact condition after the rear edge of the sheet conveyed by the pair of forward conveyance rotation members passed through the entrance of the discharge path, and the sheet on which the image has been formed by the image forming part is reversed and conveyed.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

A sheet reverse conveyance device according to an embodiment of the invention and a copying apparatus serving as an image forming apparatus having such a sheet reverse conveyance device in an apparatus main body will be described hereinbelow with reference to the drawings.

The sheet reverse conveyance device for reversing a sheet while conveying it is provided for a sheet handling apparatus for handling the sheet.

As a sheet handling apparatus, there is an image forming apparatus for forming an image onto the sheet, a document feeder for automatically feeding a document to an image reading part which is provided for the image forming apparatus and reads the document set in the image forming apparatus, a sheet processor for processing the sheet on which the image has been formed by the image forming apparatus, or the like. As an image forming apparatus, there is a copying apparatus, a laser beam printer, a facsimile apparatus, a multifunction apparatus of them, or the like. As a sheet processor, there is a stapler for stapling the sheets, a punching device for punching a hole, a folding device for folding the sheet, or the like.

Therefore, the sheet reverse conveyance device is not provided only for the copying apparatus.

Further, the sheet reverse conveyance device is provided between a fixing device 105 and a pair of discharging rollers 116, which will be explained hereinafter. The sheet reverse conveyance device may also be provided at an entrance of a double-sided reverse conveyance path 117 which is used in the case of forming images onto both sides of the sheet.

Numerical values shown in the explanation are reference numerical values and the invention is not limited by them.

<Copying Apparatus>

Figure 1:
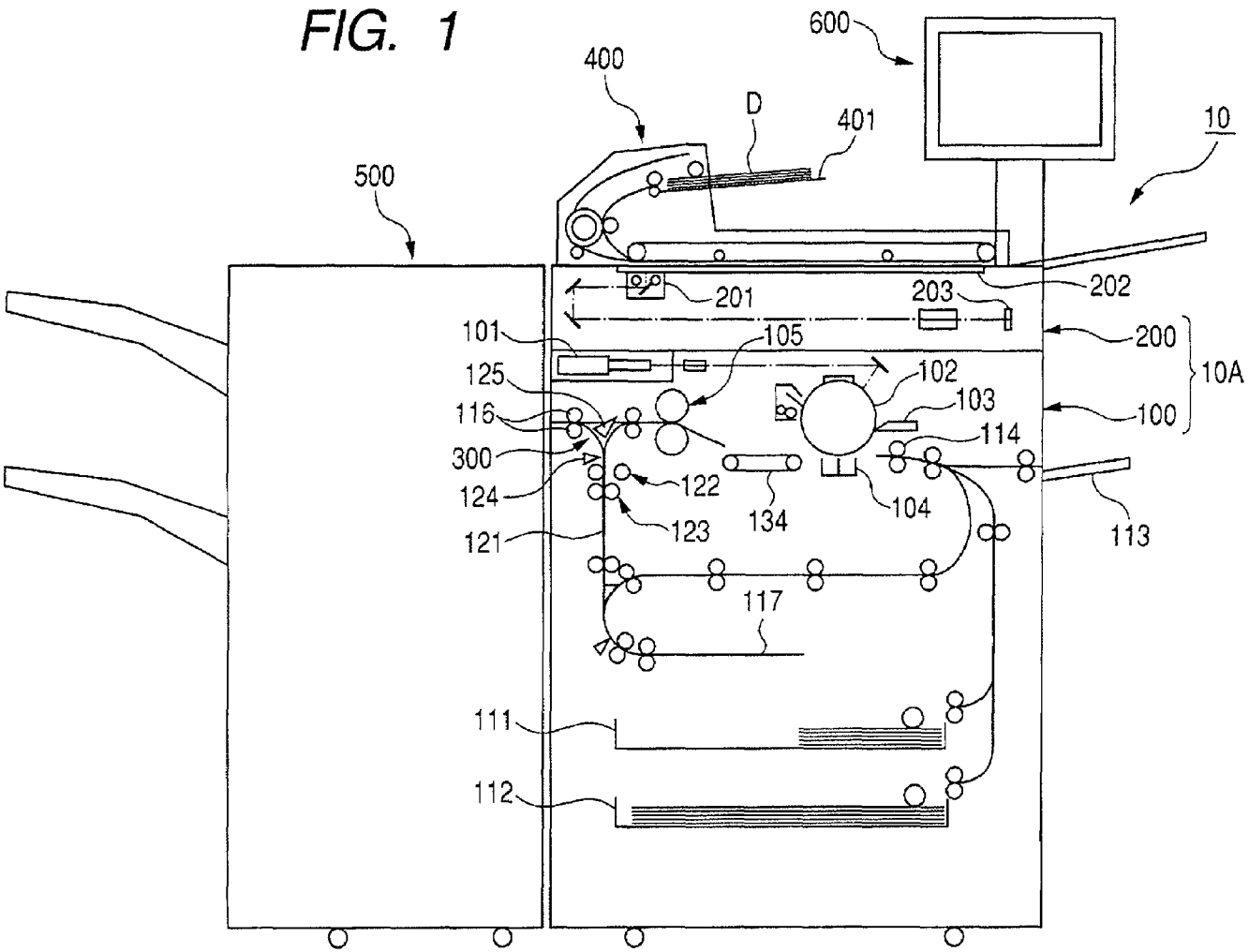
FIG. 1 is a cross sectional view taken along the sheet conveying direction of a copying apparatus serving as an image forming apparatus according to an embodiment of the invention.

FIG. 1 is a cross sectional view taken along the sheet conveying direction of the copying apparatus serving as an image forming apparatus according to the embodiment of the invention.

A copying apparatus 10 serving as an image forming apparatus forms an image onto the sheet. The copying apparatus 10 has a document feeder (ADF: automatic document feeder) 400 in an upper portion of a copying apparatus main body 10A having a printer 100 and an image reader 200. A finisher 500 is provided beside the copying apparatus 10. A sheet reverse conveyance device 300 is built in the copying apparatus main body 10A.

The image reader 200, the document feeder 400, and the finisher 500 are not always necessary. It is also possible to construct the copying apparatus 10 in such a manner that it has only the printer 100 and the printer 100 receives an image signal from the outside and forms the image onto the sheet on the basis of the image signal.

The operation of the copying apparatus 10 will now be described. The case of forming the image onto one side of the sheet will now be described.

The document feeder 400 sequentially supplies sheets of a document D set on a document tray 401 in the face-up state one by one from the head page to the left and stops the sheet to a predetermined position on platen glass 202 through a curved path. A scanner unit 201 moves from the left to the right under the document while irradiating light thereto. The reflection light of the light irradiated to the document is guided to a lens through mirrors. The light which has passed through the lens is formed as an image onto an image pickup surface of an image sensor 203. Thus, the image which has optically been read is converted into image data by the image sensor 203 and outputted to an image signal control part 281 (refer to FIG. 2). The image signal control part 281 (refer to FIG. 2) executes a predetermined process to the image data and sends the processed image data as a video signal to an exposure control part 101 of the printer 100.

The exposure control part 101 of the printer 100 irradiates a photosensitive drum 102 while scanning a laser beam on the basis of the inputted video signal. An electrostatic latent image corresponding to the scanned laser beam is formed on the photosensitive drum 102.

The electrostatic latent image on the photosensitive drum 102 as image forming means is converted into a toner image by toner (developer) which is supplied from a developing device 103 and visualized. A front edge of a sheet supplied from one of cassettes 111 and 112 and a manual paper feed tray 113 is abutted onto nips of a pair of registration rollers 114 and once stopped, and an oblique movement is corrected. After that, the sheet is conveyed between the photosensitive drum 102 and a transfer part 104 by the pair of registration rollers 114 at timing synchronized with the start timing of the irradiation of the laser beam.

The transfer part 104 transfers the toner image formed on the photosensitive drum 102 onto the sheet which passes between the photosensitive drum 102 and the transfer part 104. A conveying belt 134 conveys the sheet on which the toner image has been transferred to the fixing device 105. The fixing device 105 heats and pressurizes the sheet and fixes the toner image onto the sheet. An upstream edge portion of a flapper 125 in the sheet conveying direction is directed downward from a position shown by a solid line shown in FIG. 1. The flapper 125 guides the sheet fed from the fixing device 105 to the pair of discharging rollers 116. The pair of discharging rollers 116 discharge the sheet to the outside (finisher 500) from the printer 100. The sheet is discharged in the state where its image forming surface is set to be upward (face-up).

When the document of a plurality of pages is copied by the copying apparatus 10, since the subsequent sheet is discharged onto the precedent sheet, if the copying apparatus 10 does not discharge the sheet in the state where its image forming surface is set to be downward (face-down), the page order is reversed. Therefore, the sheet reverse conveyance device 300 switches the flapper 125 to the position shown in FIG. 1, temporarily guides the sheet fed from the fixing device 105 in the state where its image forming surface is set to face-up to a reverse conveyance path 121, switch-back conveys it, and thereafter, discharges the sheet to the outside of the printer 100. Thus, since the sheets are discharged in the page order in the state where its image forming surface is set to face-down, the page order is not reversed. A construction and the operation of the sheet reverse conveyance device 300 will be described hereinafter.

In the case of forming the images onto both sides of the sheet, the copying apparatus 10 feeds the sheet fed from the fixing device 105 to the double-sided reverse conveyance path 117, switch-back conveys and reverses it by the double-sided reverse conveyance path 117, thereafter, feeds the reversed sheet to the photosensitive drum 102, and forms the image onto the back surface of the sheet.

<System Block Diagram>

Figure 2:
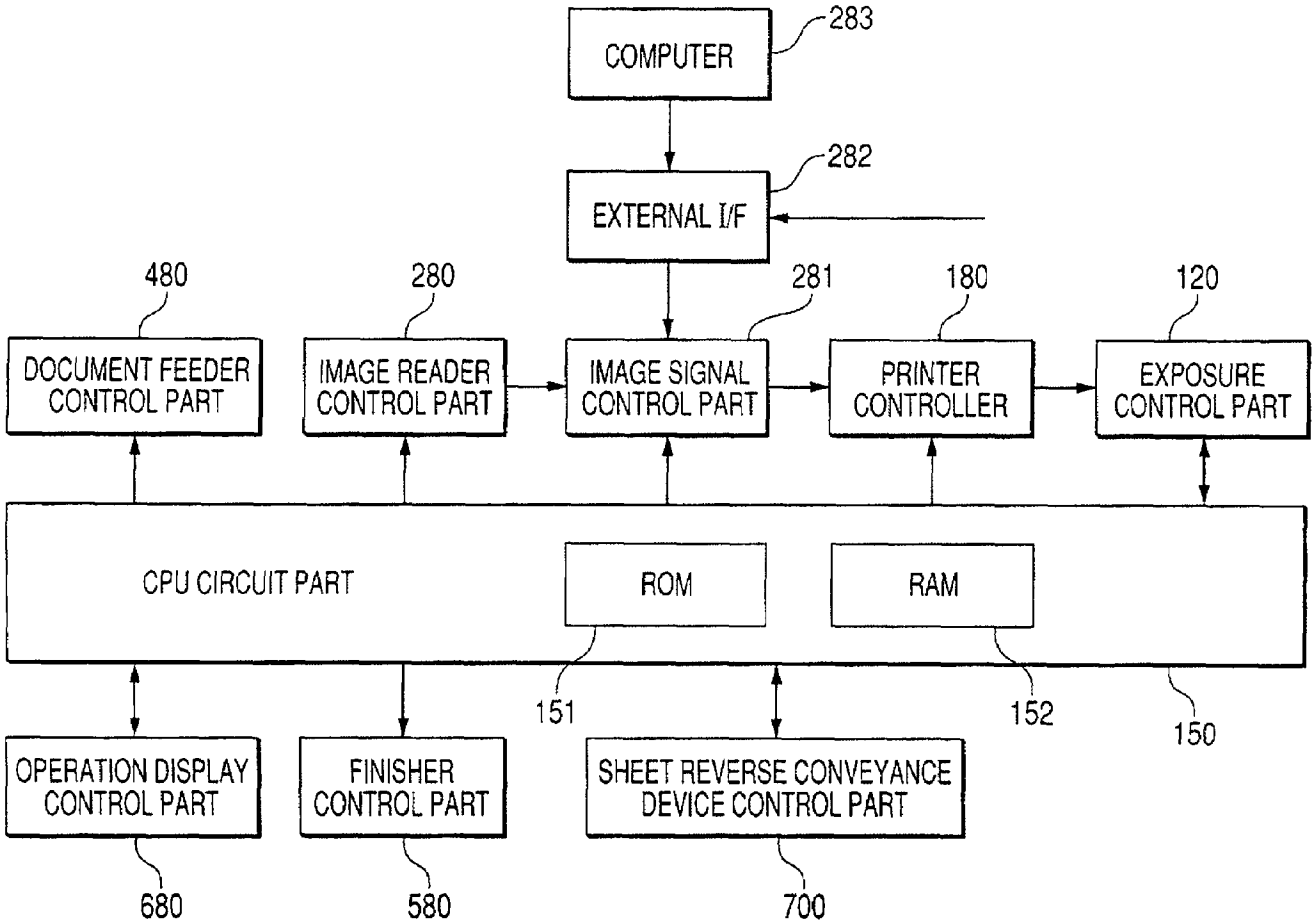
FIG. 2 is a control block diagram necessary to control the whole copying apparatus.

FIG. 2 is a control block diagram necessary to control the whole copying apparatus.

A CPU circuit part 150 has therein a CPU (not shown), a ROM 151, and a RAM 152 and collectively controls control parts 480, 280, 281, 180, 120, 680, 580, and 700 in accordance with a control program stored in the ROM 151. The RAM 152 temporarily holds control data and is used as a work area for an arithmetic operating process accompanied with the control.

The document feeder control part 480 drives the document feeder 400 on the basis of an instruction from the CPU circuit part 150. The image reader control part 280 controls the driving of the scanner unit 201, image sensor 203, and the like mentioned above and transfers an analog image signal outputted from the image sensor 203 to the image signal control part 281.

The image signal control part 281 converts the analog image signal from the image sensor 203 into a digital signal, thereafter, executes various processes thereto, converts the digital signal into a video signal, and outputs it to the printer controller 180. The image signal control part 281 can also execute various processes to the digital image signal inputted from an external computer 283 through an external I/F 282, convert the digital image signal into the video signal, and output the video signal to the printer controller 180. The processing operation by the image signal control part 281 is executed by the control of the CPU circuit part 150. The printer controller 180 controls the exposure control part 120 on the basis of the inputted video signal.

The operation display control part 680 transmits and receives information between an operation display part 600 (refer to FIG. 1) which is operated by the user and the CPU circuit part 150. The operation display part 600 has a plurality of keys for setting various functions regarding the image creation, a display part for displaying information showing a setting state, and the like. The operation display part 600 outputs a key signal corresponding to the operation of each key to the CPU circuit part 150 and displays the corresponding information on the basis of the signal from the CPU circuit part 150 onto a display panel.

The sheet reverse conveyance device control part 700 as a control part controls the sheet reverse conveyance device 300.

<Sheet Reverse Conveyance Device>

(Explanation of Structure)

Figure 3:
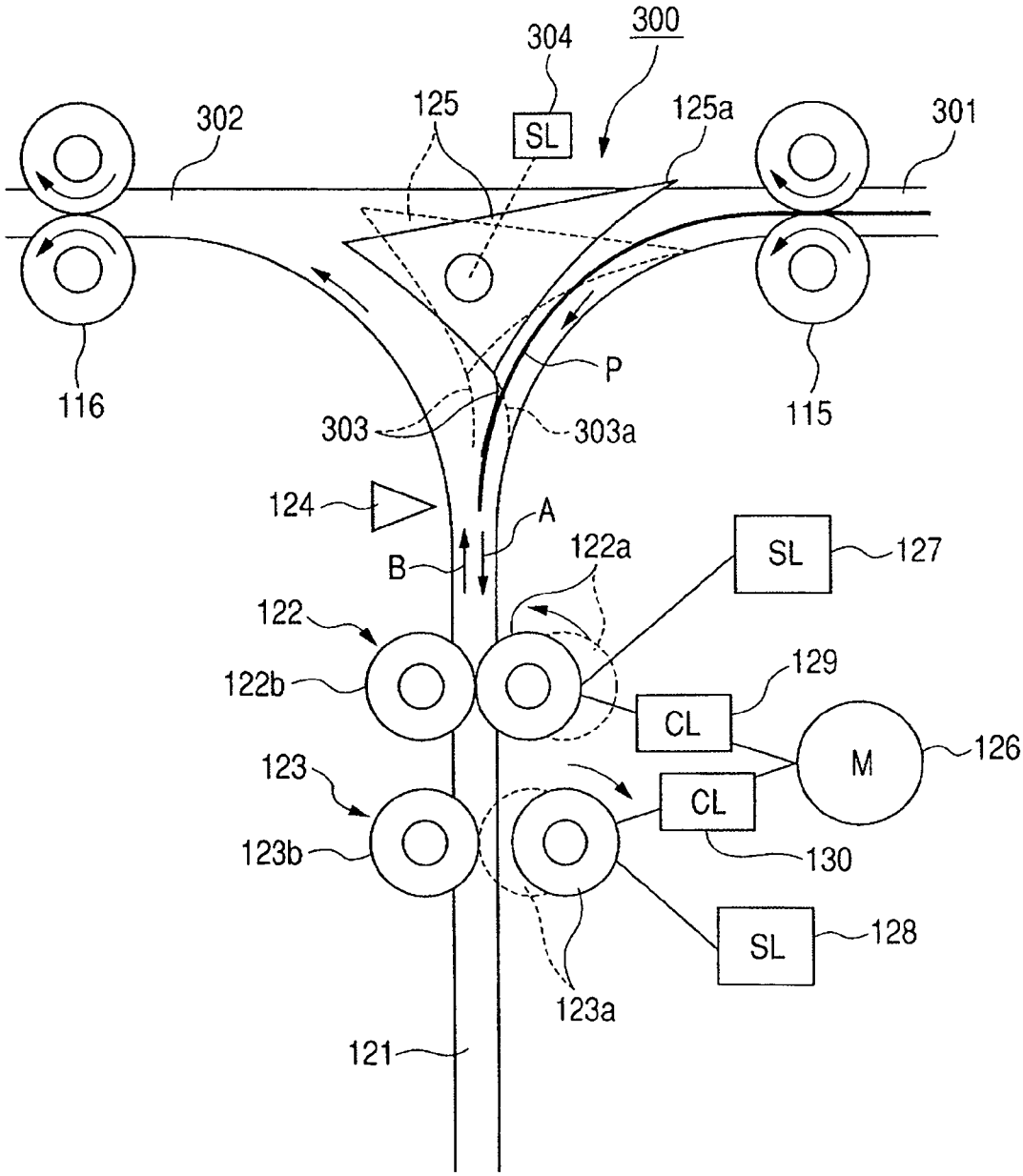
FIG. 3 is a schematic front view of a sheet reverse conveyance device.

FIG. 3 is a schematic front view of the sheet reverse conveyance device. In the sheet reverse conveyance device 300, after the sheet which had entered the reverse conveyance path 121 from an entry path 301 was temporarily conveyed in the reverse conveyance path 121, it is reversely conveyed to a discharge path 302 different from the entry path 301 and reversed. The sheet reverse conveyance device 300 can also guide the sheet straight from the entry path 301 to the discharge path 302 without reversing it. The entry path 301, discharge path 302, and reverse conveyance path 121 are formed in a Y-character shape as a whole.

A pair of conveying rollers 115 are provided for the entry path 301. The pair of discharging rollers 116 are provided for the discharge path 302.

The flapper 125 pivots to either a position shown by a broken line or a position shown by a solid line by a solenoid 304. When an upstream edge portion 125*a* of the flapper 125 is directed downward as shown in the broken line position, the flapper 125 guides a sheet P conveyed by the pair of conveying rollers 115 so as to pass through the entry path 301 to the discharge path 302 by the upstream edge portion 125*a*.

When the upstream edge portion 125*a* of the flapper 125 is directed upward as shown in the solid line position, the flapper 125 guides the sheet to the reverse conveyance path 121 by the upstream edge portion 125*a*. A guide member 303 having elasticity for preventing the sheet from entering the entry path 301 when the sheet is conveyed from the reverse conveyance path 121 to the discharge path 302 is provided for the flapper 125.

In the following description, the operation to feed the sheet into the reverse conveyance path 121 is called "forward conveyance" and the operation to feed out the sheet from the reverse conveyance path 121 is called "reverse conveyance". That is, in FIG. 3, the operation to convey the sheet in the direction shown by an arrow A is called "forward conveyance" and the operation to convey the sheet in the direction shown by an arrow B is called "reverse conveyance".

A pair of forward conveying rollers 122 serving as a pair of forward conveyance rotation members for forwardly conveying the sheet into the reverse conveyance path 121 and a pair of reverse conveying rollers 123 serving as a pair of reverse conveyance rotation members for reversely feeding out the sheet from the reverse conveyance path 121 are provided for the reverse conveyance path 121. The pair of forward conveying rollers 122 are constructed by a forward conveyance immobile roller 122*b* and a forward conveyance touch/detach roller 122*a* which touches and detaches from the forward conveyance immobile roller 122*b*. Similarly, the pair of reverse conveying rollers 123 are constructed by a reverse conveyance immobile roller 123*b* and a reverse conveyance touch/detach roller 123*a* which touches and detaches from the reverse conveyance immobile roller 123*b*.

The touching/detaching operations in the pair of forward conveying rollers 122 for allowing the forward conveyance touch/detach roller 122*a* to be touched and detached to/from the forward conveyance immobile roller 122*b* are executed by a forward conveyance solenoid 127. The touching/detaching operations in the pair of reverse conveying rollers 123 for allowing the reverse conveyance touch/detach roller 123*a* to be touched and detached to/from the reverse conveyance immobile roller 123*b* are executed by a reverse conveyance solenoid 128. The forward conveyance solenoid 127 and the reverse conveyance solenoid 128 serving as operating parts construct rotation member pair touch/detach means.

The forward conveyance touch/detach roller 122*a* and the reverse conveyance touch/detach roller 123*a* are driven and rotated by a common reverse conveying motor 126. However, although the forward conveyance touch/detach roller 122*a* and the reverse conveyance touch/detach roller 123*a* are rotated by the common reverse conveying motor 126, the forward conveyance touch/detach roller 122*a* rotates in such a direction as to forwardly convey the sheet and the reverse conveyance touch/detach roller 123*a* rotates in such a direction as to reversely convey the sheet. That is, the forward conveyance touch/detach roller 122*a* and the reverse conveyance touch/detach roller 123*a* rotate in the opposite directions. The forward conveyance touch/detach roller 122*a* and the reverse conveyance touch/detach roller 123*a* are connected to the reverse conveying motor 126 through a forward conveyance clutch 129 and a reverse conveyance clutch 130 so that their rotations can be individually stopped. Even if the reverse conveying motor 126 is rotating, by turning off the forward conveyance clutch 129 and the reverse conveyance clutch 130, the forward conveyance touch/detach roller 122*a* and the reverse conveyance touch/detach roller 123*a* can be stopped, respectively.

A branch sensor 125 is provided near the boundary between the reverse conveyance path 121 and the discharge path 302, that is, near the entrance of the discharge path 302.

(Explanation of the Operation)

Figure 5:
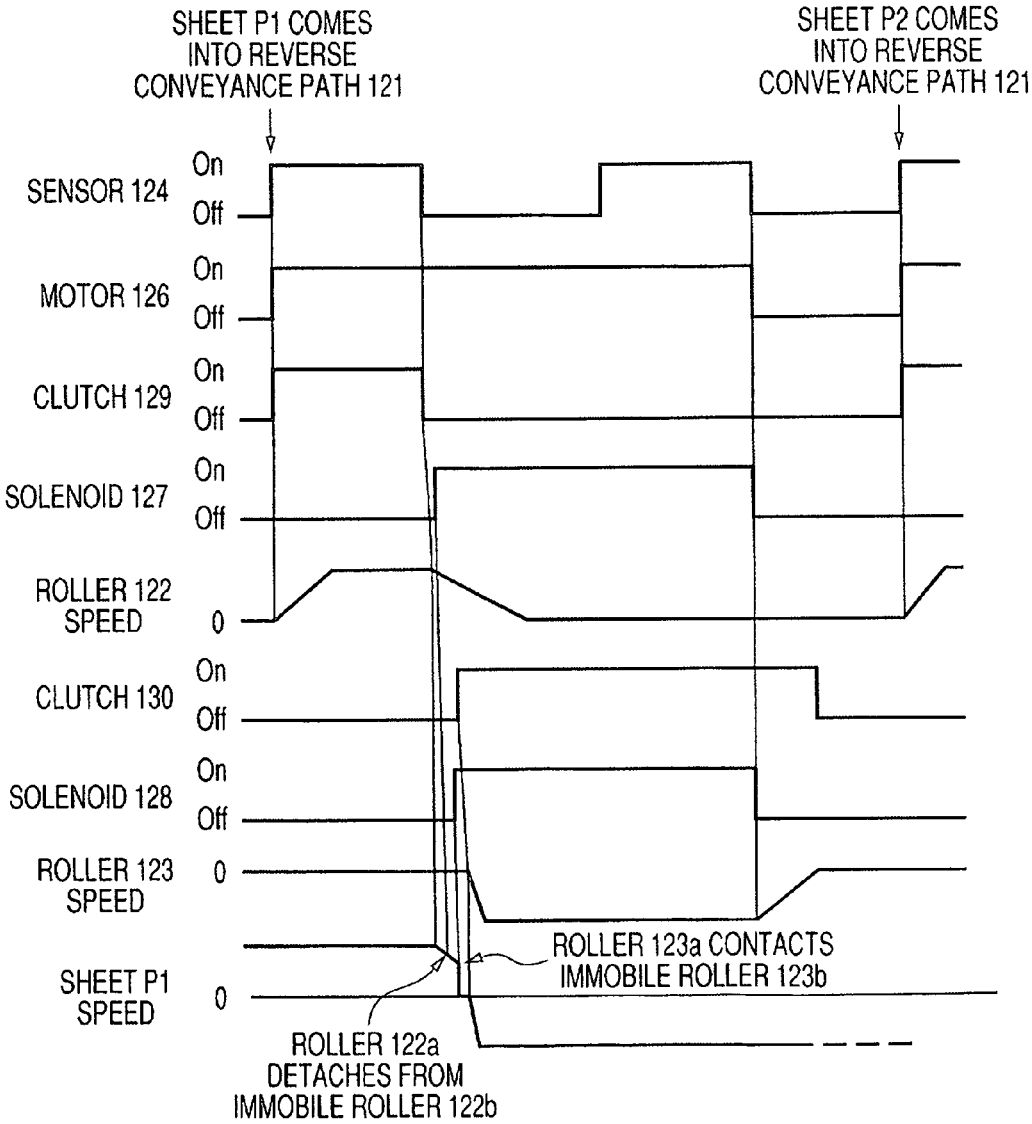
FIG. 5 is a timing chart showing timing of the motion of each part of the sheet reverse conveyance device.
Figure 6:
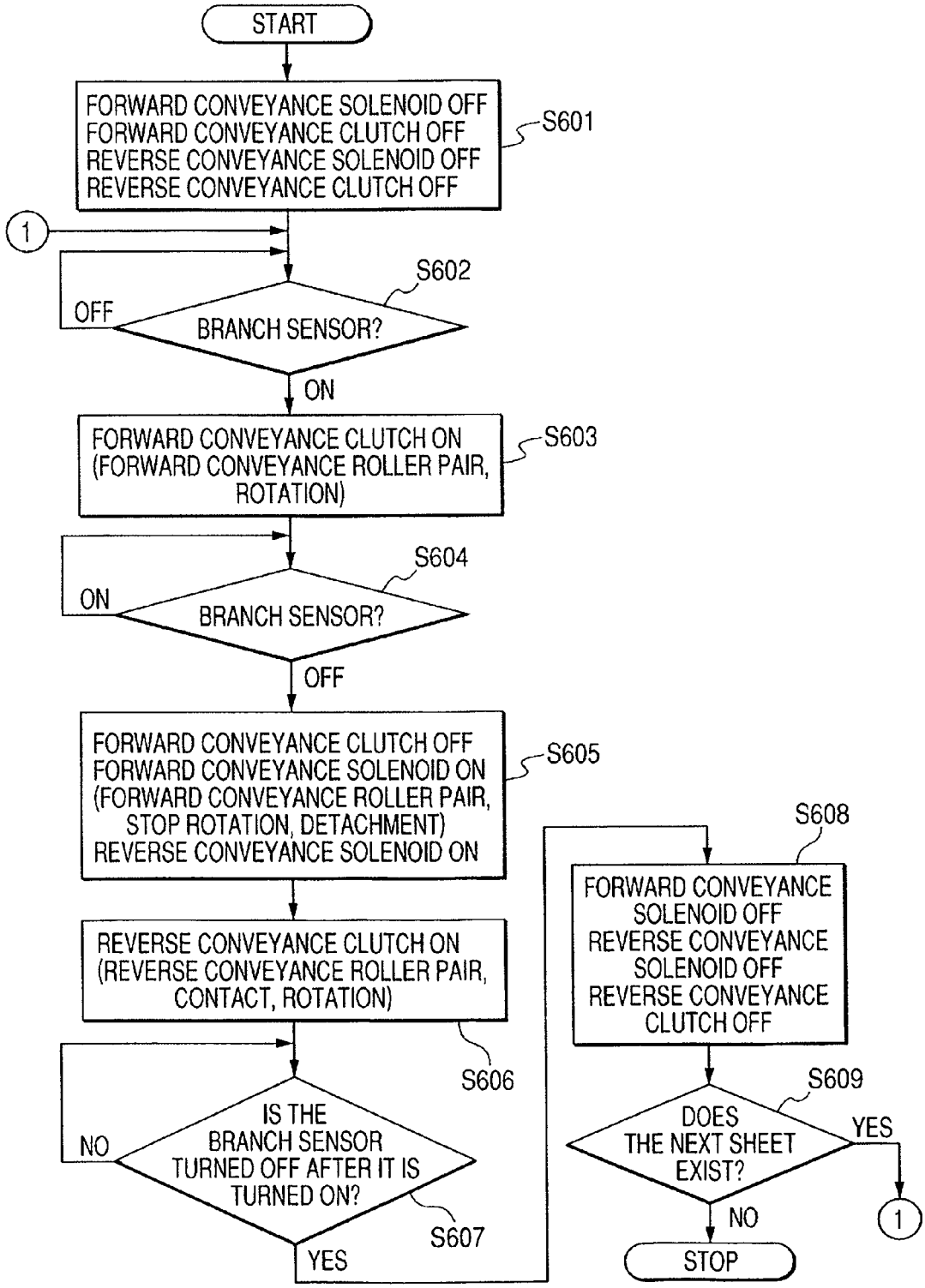
FIG. 6 is a flowchart for explaining the operation of the sheet reverse conveyance device.

FIGS. 4A, 4B, 4C, 4D, 4E and 4F are diagrams for explaining the operation in the case where the sheet reverse conveyance device reverses the sheet in which the image has been formed on its upper surface and discharges it in the face-down state. FIG. 5 is a timing chart showing timing of the motion of each part of the sheet reverse conveyance device. FIG. 6 is a flowchart for explaining the operation of the sheet reverse conveyance device.

In FIG. 3, the forward conveyance solenoid 127 and the reverse conveyance solenoid 128 are OFF when the forward conveyance touch/detach roller 122*a* and the reverse conveyance touch/detach roller 123*a* are held at the positions shown by the solid lines and are ON when the rollers 122*a* and 123*a* are held at the positions shown by the broken lines.

Figure 4A:
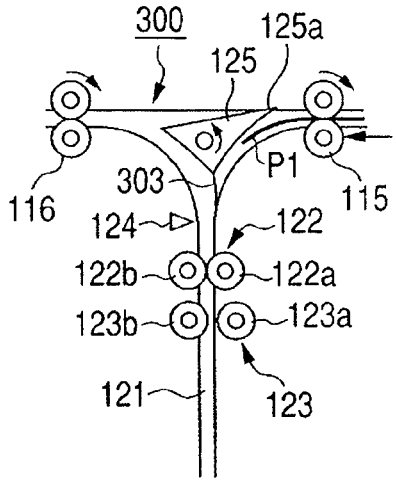
FIGS. 4A, 4B, 4C, 4D, 4E and 4F are diagrams showing stages until the sheet reverse conveyance device reverses a sheet in which an image has been formed on its upper surface and discharges the sheet in a face-down state.
Figure 4B:
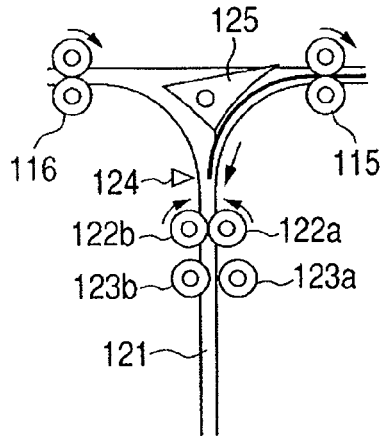

The sheet reverse conveyance device control part (hereinafter, simply abbreviated to a "control part") 700 (refer to FIG. 2) turns off the forward conveyance solenoid 127, forward conveyance clutch 129, reverse conveyance solenoid 128, and reverse conveyance clutch 130 (FIG. 4A, S601 in FIG. 6). The control part 700 makes the solenoid 304 operative so as to rotate the flapper 125 in the direction shown by an arrow in FIG. 4A and allows the flapper 125 to be on standby so that the sheet can be guided from the entry path 301 to the reverse conveyance path 121.

The control part 700 rotates the pair of conveying rollers 115. The pair of conveying rollers 115 convey a sheet P1 conveyed from the fixing device 105 in the face-up state toward the flapper 125. The flapper 125 guides the sheet to the reverse conveyance path 121. Since the forward conveyance solenoid 127 is OFF at this time, the pair of forward conveying rollers 122 is in the contact condition so that the sheet can be conveyed into the reverse conveyance path 121. That is, the forward conveyance touch/detach roller 122*a* is in contact with the forward conveyance immobile roller 122*b*. Since the reverse conveyance solenoid 128 is OFF, the pair of reverse conveying rollers 123 are in the detachment condition so as not to apply a reverse conveying force to the sheet. That is, the reverse conveyance touch/detach roller 123*a* are away from the reverse conveyance immobile roller 123*b*.

When the flapper 125 is located at the solid line position, the guide member 303 is in contact with the inner wall of the entrance or upstream side of the reverse conveyance path 121 as shown at reference numeral 303*a* in FIG. 3. However, since the guide member 303 has the elasticity, it is pushed backward by the front edge of the sheet P, thereby allowing the sheet P to enter the reverse conveyance path 121.

When the branch sensor 124 detects the head of the sheet P1 (FIG. 4B, S602), the control part 700 activates the common reverse conveying motor 126 and turns on the forward conveyance clutch 129 (S603), thereby rotating the forward conveyance touch/detach roller 122*a*. The pair of forward conveying rollers 122 pull the sheet into the reverse conveyance path 121. At this time, since the reverse conveyance solenoid 128 and the reverse conveyance clutch 130 are still OFF, the reverse conveyance touch/detach roller 123*a* are away from the reverse conveyance immobile roller 123*b* and keeps the rotation in the stop state.

Figure 4C:
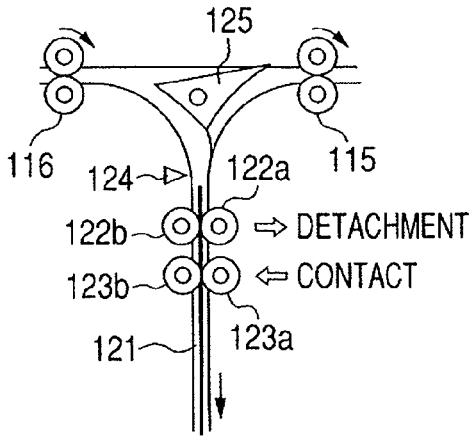

When the rear edge of the sheet P1 passes through the branch sensor 124, the branch sensor 124 does not detect the sheet P1 (FIG. 4C, S604). Thus, the control part 700 turns off the forward conveyance clutch 129, thereby stopping the rotation of the forward conveyance touch/detach roller 122*a*. When the forward conveyance clutch 129 is turned off, the sheet P1 moves downward in the diagram by inertia. The control part 700 turns on the forward conveyance solenoid 127, thereby detaching the forward conveyance touch/detach roller 122*a* from the forward conveyance immobile roller 122*b*. Subsequently, the control part 700 turns on the reverse conveyance solenoid 128, thereby starting the reverse conveyance touch/detach roller 123*a* being come into contact with the reverse conveyance immobile roller 123*b* (FIG. 4C, S605). When the reverse conveyance solenoid 128 is turned on, the reverse conveyance touch/detach roller 123*a* is come into contact with the reverse conveyance immobile roller 123*b* after the elapse of a response time of the reverse conveyance solenoid 128. At this point of time, the reverse conveyance touch/detach roller 123*a* is not rotating. Therefore, the pair of reverse conveying rollers 123 grasp the sheet P1, so that the sheet P1 which has moved by the inertia stops completely.

Since the pair of reverse conveying rollers 123 grasp the sheet which is dropping, there is a risk that the rollers 123 fail to grasp the sheet. Therefore, a distance between the pair of forward conveying rollers 122 and the pair of reverse conveying rollers 123 is assured lest the pair of reverse conveying rollers 123 fail to grasp the sheet P1. It is also possible to construct in such a manner that after the pair of reverse conveying rollers 123 entered the contact condition, the pair of forward conveying rollers 122 enters the detachment condition, and after the clutch 129 was turned off, the clutch 128 is turned on.

Figure 4D:
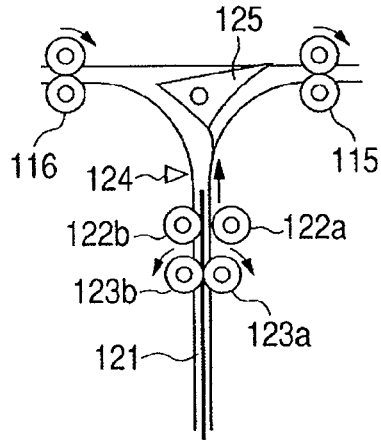

The control part 700 turns on the reverse conveyance clutch 130, thereby starting the rotation of the reverse conveyance touch/detach roller 123*a*. Thus, the pair of reverse conveying rollers 123 reversely convey the sheet (FIG. 4D, S606).

Since the sheet P1 is reversely conveyed, the portion which has been the rear edge so far becomes the front edge. The pair of reverse conveying rollers 123 convey the sheet. The sheet is guided by the guide member 303 and the flapper 125 and conveyed to the discharge path 302.

When the sheet completely passes through the branch sensor 124 (S607), the control part 700 turns off the motor 126, reverse conveyance clutch 130, forward conveyance solenoid 127, and reverse conveyance solenoid 128, thereby returning the pair of forward conveying rollers 122 and the pair of reverse conveying rollers 123 to the initial state (S608). The forward conveyance clutch 129 has already been turned off in step S605.

Figure 4E:
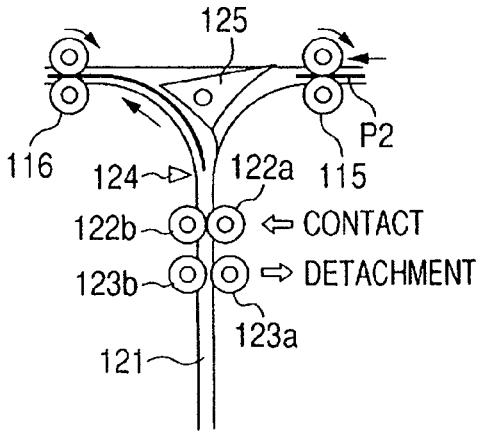

Thus, the pair of forward conveying rollers 122 which have already been in the detachment condition enter the contact condition, the pair of reverse conveying rollers 123 which have already been in the contact condition enter the detachment condition, and the sheet reverse conveyance device 300 enters the state where a sheet P2 which is subsequently sent can be reversely conveyed (FIG. 4E).

Figure 4F:
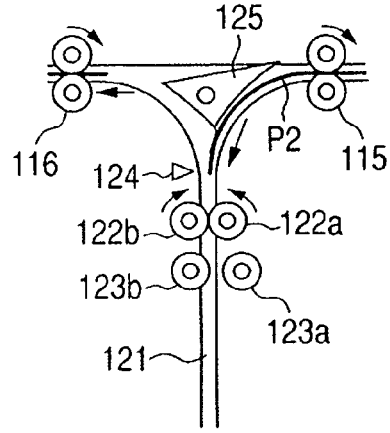

The sheet P1 fed out of the reverse conveyance path 121 is discharged from the printer 100 toward the outside (finisher 500) by the pair of discharging rollers 116. The reverse conveying process is also executed to the next sheet P2 and the sheet P2 is reversed in a manner similar to the precedent sheet P1 (FIG. 4F). The reversing operation of the sheet reverse conveyance device 300 is executed until there are no more sheets (S609).

The conventional sheet reverse conveyance device has executed the forward conveyance and the reverse conveyance of the sheet by the pair of rollers. Therefore, since the pair of rollers temporarily enter the stop state when the rotation is changed from the forward rotation to the reverse rotation, a reversing time of hundreds of milliseconds is required. On the other hand, since the sheet reverse conveyance device 300 shown in FIG. 3 executes the forward conveyance and the reverse conveyance of the sheet by the different pairs of the rollers, the sheet can be reversed without waiting for the stop of one of the pairs of the rollers. Specifically speaking, the necessary reversing time is equal to about 100 msec and is shorter than the conventional one.

That is, since the sheet reverse conveyance device 300 shown in FIG. 3 reverses the sheet by the touch/detach operations of the pair of forward conveying rollers 122 and the pair of reverse conveying rollers 123 by the forward conveyance solenoid 127 and the reverse conveyance solenoid 128, the sheet can be reversed irrespective of the acceleration and deceleration of the reverse conveying motor 126. The reversing time necessary to reverse the sheet can be shortened more than the conventional one.

In the sheet reverse conveyance device 300 shown in FIG. 3, a rotational force of the reverse conveying motor 126 is transferred to the pair of forward conveying rollers 122 by the forward conveyance clutch 129 and transferred to the pair of reverse conveying rollers 123 by the reverse conveyance clutch 130. Therefore, the transfer of the rotational force to the pair of rollers 122 and the pair of rollers 123 can be turned on and off irrespective of the acceleration and deceleration of the reverse conveying motor 126, so that the sheet can be accurately reversed.

The sheet reverse conveyance device 300 shown in FIG. 3 can execute the reversing process of the sheet in about 100 msec even if a response time of the forward conveyance solenoid 127 and the reverse conveyance solenoid 128 and a response connecting time of the forward conveyance clutch 129 and the reverse conveyance clutch 130 are included, so that the necessary reversing time can be shortened more than the conventional one.

Figure 11:
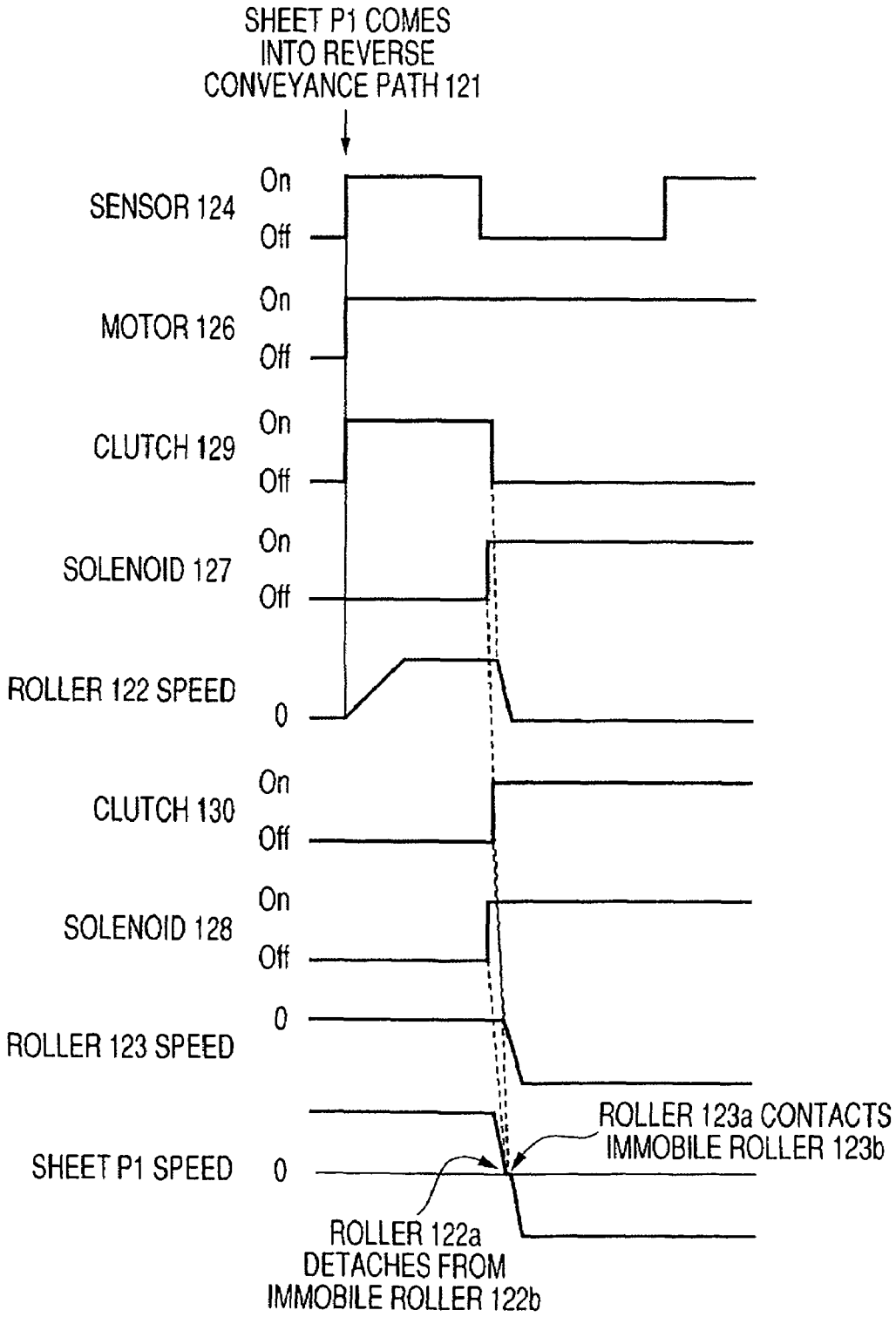
FIG. 11 is a timing chart showing timing of the motion of each part in a modification of the sheet reverse conveyance device.

FIG. 11 shows a timing chart in a modification. The apparatus is constructed in such a manner that the detachment of the pair of forward conveying rollers 122 by the forward conveyance solenoid 127 and the contact of the pair of reverse conveying rollers 123 by the reverse conveyance solenoid 128 are simultaneously executed in consideration of each response time. The apparatus is also constructed in such a manner that the rotation stop of the pair of forward conveying rollers 122 by the operation of the forward conveyance clutch 129 and the rotation start of the pair of reverse conveying rollers 123 by the operation of the reverse conveyance clutch 130 are simultaneously executed in consideration of each response time. Further, the detachment of the pair of forward conveying rollers 122 by the forward conveyance solenoid 127 and the rotation stop of the pair of forward conveying rollers 122 by the operation of the forward conveyance clutch 129 are executed at the same timing. The contact of the pair of reverse conveying rollers 123 by the reverse conveyance solenoid 128 and the rotation start of the pair of reverse conveying rollers 123 by the operation of the reverse conveyance clutch 130 are also executed at the same timing. A brake is provided for the pair of forward conveying rollers 122 in order to more rapidly accomplish the rotation stop of the pair of forward conveying rollers 122. The forward conveyance solenoid 127, reverse conveyance solenoid 128, forward conveyance clutch 129, and reverse conveyance clutch 130 are made operative at predetermined time so that their operation timing coincides with, for example, the foregoing timing from the detection of the sheet by the branch sensor 124.

<Another Sheet Reverse Conveyance Device>

(Explanation of the Structure)

Figure 7:
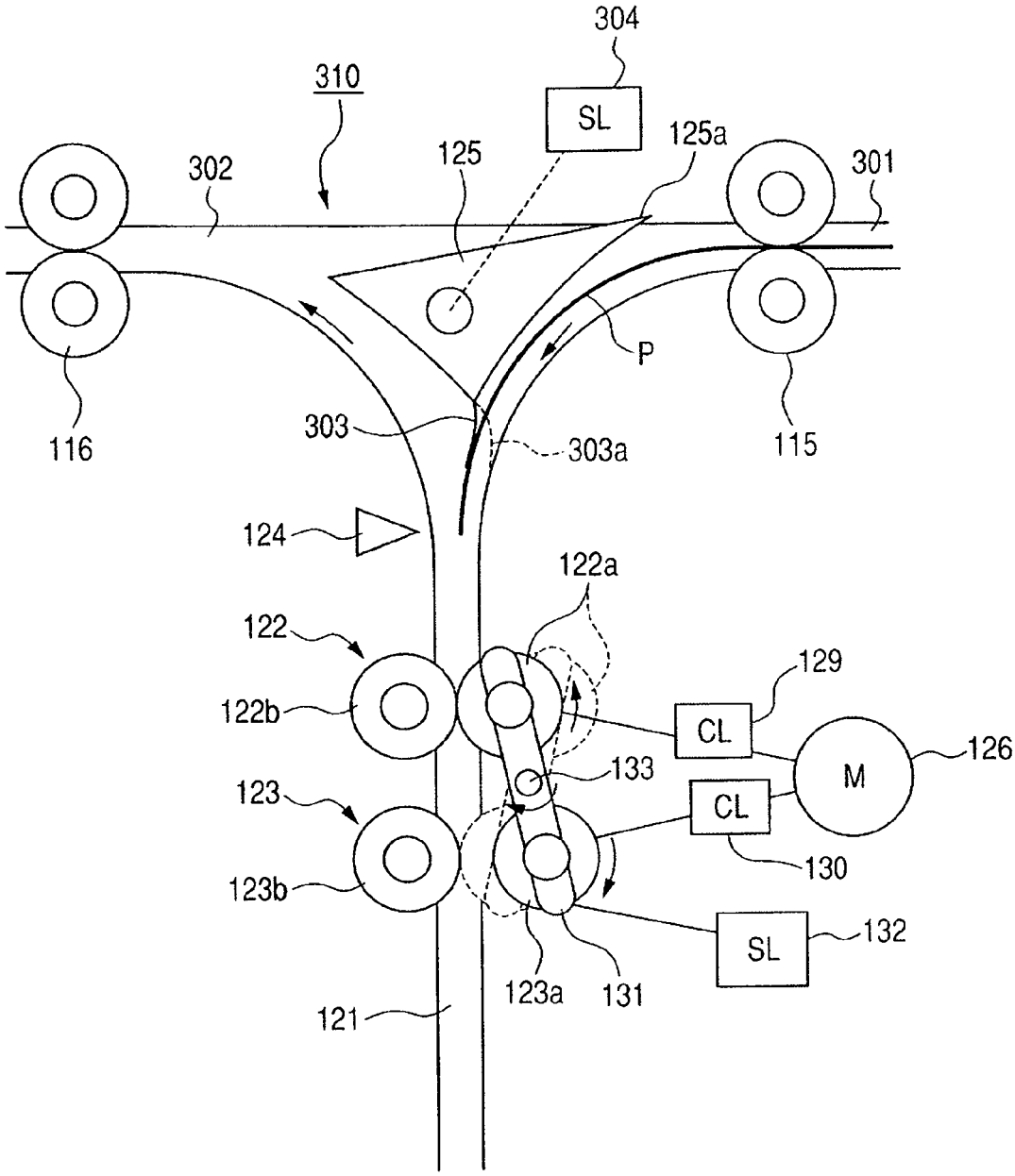
FIG. 7 is a schematic front view of another sheet reverse conveyance device.

Although the touch and detachment of the pair of forward conveying rollers 122 and the touch and detachment of the pair of reverse conveying rollers 123 are executed by the different solenoids in the sheet reverse conveyance device 300 shown in FIG. 3, they may be also executed by a common solenoid 132 as in a sheet reverse conveyance device 310 shown in FIG. 7.

The sheet reverse conveyance device 310 shown in FIG. 7 will be described hereinbelow. The same portions as those in the sheet reverse conveyance device 300 shown in FIG. 3 are designated by the same reference numerals and their description is omitted here. Since a control block diagram of the device 310 is similar to that of FIG. 2, its drawing is omitted here. In the sheet reverse conveyance device 310 shown in FIG. 7, it is also assumed that the operation is controlled by the sheet reverse conveyance device control part 700 as a control part.

That is, in the sheet reverse conveyance device 310, the touch and detachment of the pair of forward conveying rollers 122 and the touch and detachment of the pair of reverse conveying rollers 123 are executed in a structure in which the forward conveyance touch/detach roller 122*a* and the reverse conveyance touch/detach roller 123*a* serving as rotation members are provided at both ends of a link 131 which is rotatable around an axis 133 of its intermediate portion as rotational center and the solenoid 132 is connected to one end of the link 131. The link 131 as a pivot member and the solenoid 132 as an operating part construct rotation member pair touch/detach means.

(Explanation of the Operation)

Figure 9:
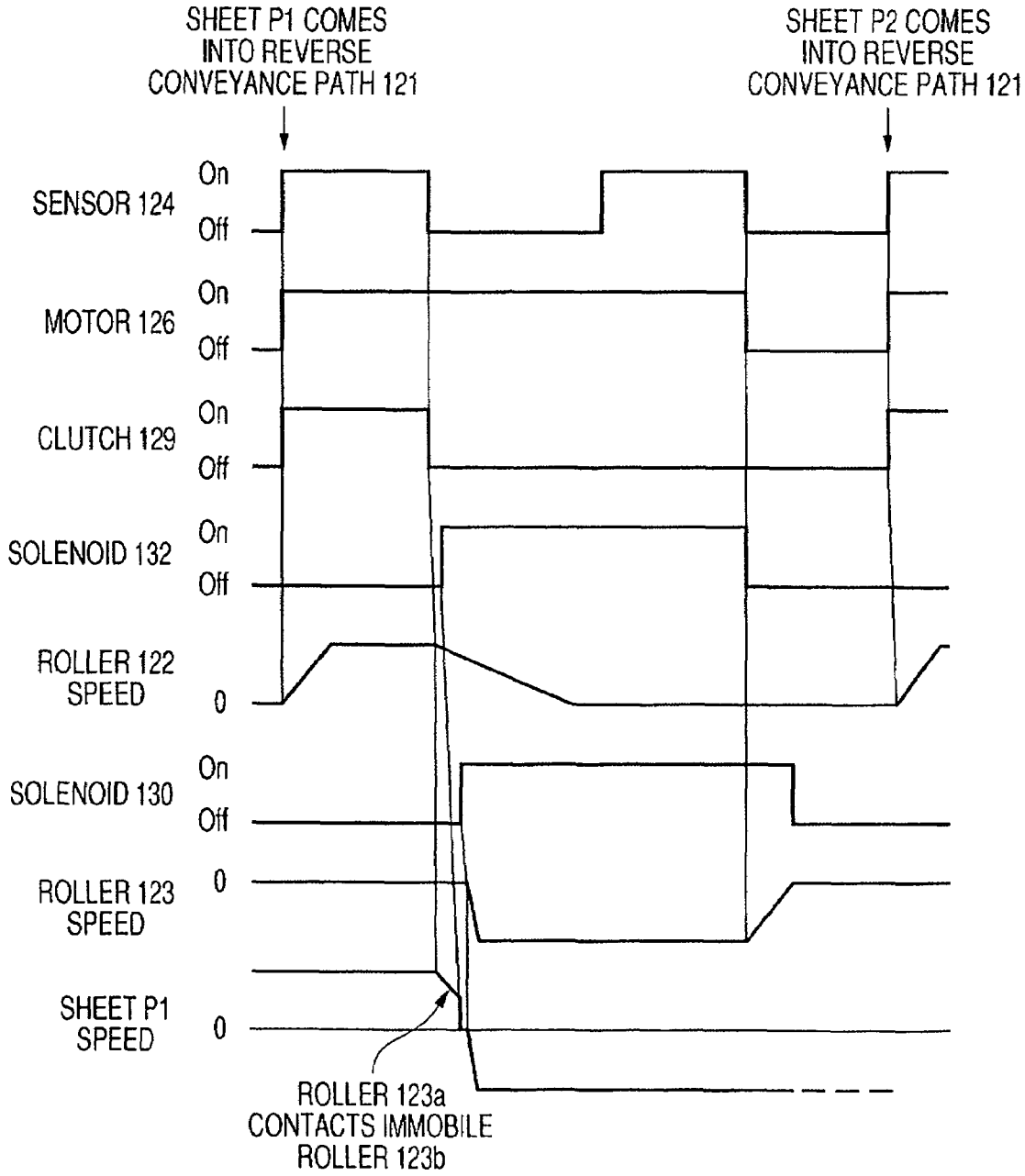
FIG. 9 is a timing chart showing timing of the motion of each part of the sheet reverse conveyance device shown in FIG. 7.
Figure 10:
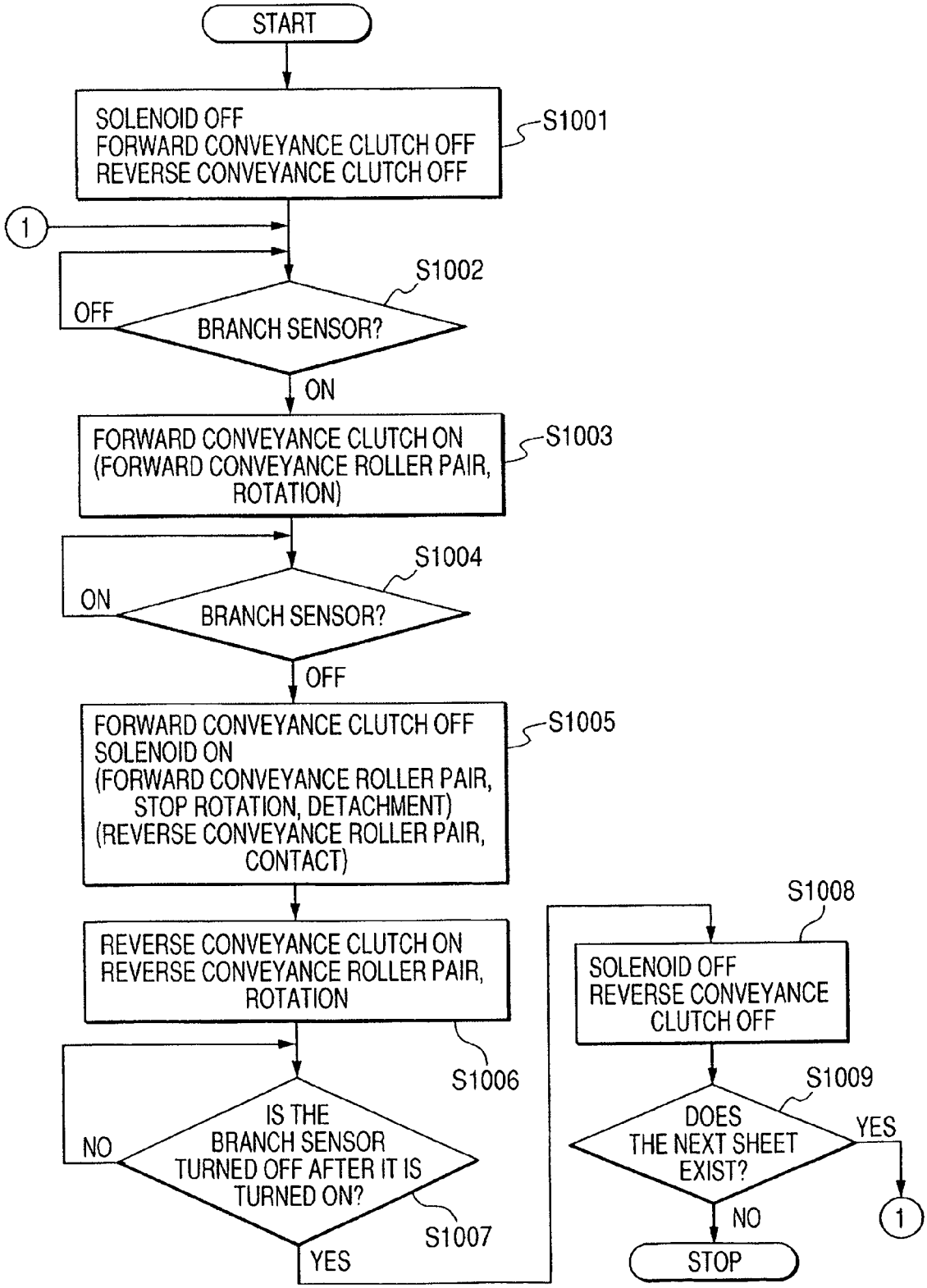
FIG. 10 is a flowchart for explaining the operation of the sheet reverse conveyance device shown in FIG. 7.

FIGS. 8A, 8B, 8C, 8D, 8E and 8F are diagrams for explaining the operation in the case where the sheet reverse conveyance device reverses the sheet in which the image has been formed on its upper surface and discharges the sheet in the face-down state. FIG. 9 is a timing chart showing timing of the motion of each part of the sheet reverse conveyance device. FIG. 10 is a flowchart for explaining the operation of the sheet reverse conveyance device.

In FIG. 7, the solenoid 132 is OFF when the forward conveyance touch/detach roller 122*a* and the reverse conveyance touch/detach roller 123*a* are held at the solid line position, and the solenoid 132 is ON when they are held at the broken line position.

Figure 8A:
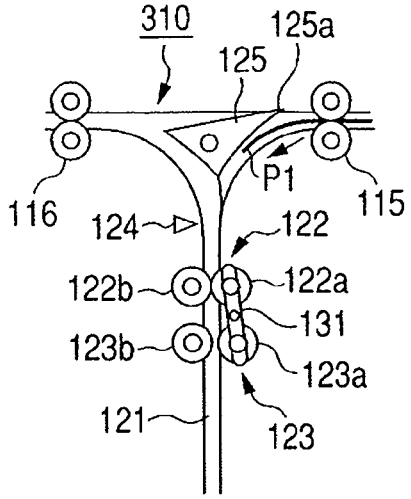
FIGS. 8A, 8B, 8C, 8D, 8E and 8F are diagrams for explaining the operation in the case where the sheet reverse conveyance device shown in FIG. 7 reverses a sheet in which an image has been formed on its upper surface and discharges the sheet in a face-down state.
Figure 8B:
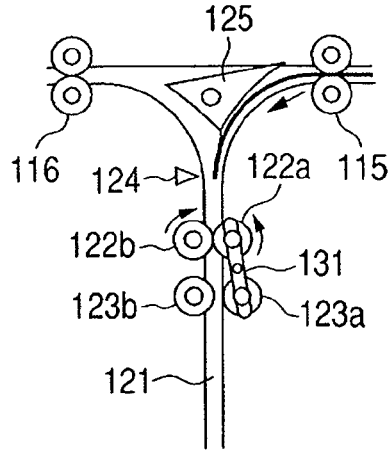

The control part 700 (refer to FIG. 2) turns off the solenoid 132, forward conveyance clutch 129, and reverse conveyance clutch 130 (FIG. 8A, S601 in FIG. 10). The control part 700 makes the solenoid 304 operative so as to rotate the flapper 125 to the left in FIG. 8A and allows the flapper 125 to be on standby so that the sheet can be guided from the entry path 301 to the reverse conveyance path 121.

The control part 700 rotates the pair of conveying rollers 115. The pair of conveying rollers 115 convey the sheet P1 conveyed from the fixing device 105 in the face-up state toward the flapper 125. The flapper 125 guides the sheet to the reverse conveyance path 121. At this time, the solenoid 132 is OFF. Therefore, since the link 131 is inclined to the position of the solid line, the pair of forward conveying rollers 122 is set into the contact condition and the pair of reverse conveying rollers 123 is set into the detachment condition. That is, the forward conveyance immobile roller 122*b* is come into contact with the forward conveyance touch/detach roller 122*a* and the pair of forward conveying rollers 122 can convey the sheet into the reverse conveyance path 121. The reverse conveyance touch/detach roller 123*a* detaches from the reverse conveyance immobile roller 123*b* and the pair of reverse conveying rollers 123 do not apply a reverse conveying force to the sheet.

When the flapper 125 is located at the solid line position, the guide member 303 is in contact with the inner wall of the entrance or upstream side of the reverse conveyance path 121 as shown at reference numeral 303*a* in FIG. 7. However, since the guide member 303 has the elasticity, it is pressed backward by the front edge of the sheet P, thereby allowing the sheet P to enter the reverse conveyance path 121.

When the branch sensor 124 detects the head of the sheet P1 (FIG. 8B, S1002), the control part 700 makes the reverse conveying motor 126 operative and turns on the forward conveyance clutch 129 (S1003), thereby rotating the forward conveyance touch/detach roller 122*a*. The pair of forward conveying rollers 122 pull the sheet into the reverse conveyance path 121. At this time, since the solenoid 132 and the reverse conveyance clutch 130 are still OFF, the reverse conveyance touch/detach roller 123*a* detaches from the reverse conveyance immobile roller 123*b* and stops the rotation.

Figure 8C:
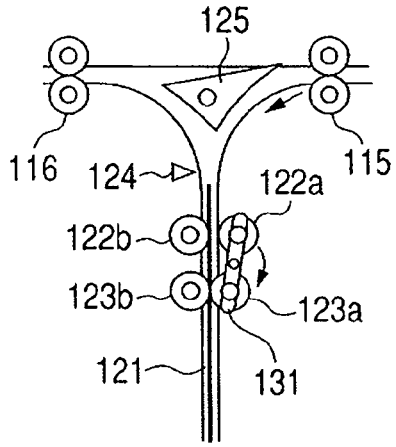

When the rear edge of the sheet P1 passes through the branch sensor 124, the branch sensor 124 does not detect the sheet P1 (FIG. 8C, S1004). Thus, the control part 700 turns off the forward conveyance clutch 129, thereby stopping the rotation of the forward conveyance touch/detach roller 122*a*. When the forward conveyance clutch 129 is turned off, the sheet P1 moves downward in the diagram by inertia. The control part 700 turns on the solenoid 132, thereby changing the inclination of the link 131 in the direction shown by an arrow. The forward conveyance touch/detach roller 122*a* starts to detach from the forward conveyance immobile roller 122*b* and the reverse conveyance touch/detach roller 123*a* starts to be come into contact with the reverse conveyance immobile roller 123*b* (FIG. 8C, S1005). The pair of forward conveying rollers 122 enter the detachment condition and the pair of reverse conveying rollers 123 enters the contact condition after the elapse of the response time of the solenoid 132. At this point of time, the reverse conveyance touch/detach roller 123*a* is not rotated. Therefore, the pair of reverse conveying rollers 123 grasp the sheet P1. Thus, the sheet P1 which has been moving by the inertia stops completely.

Since the pair of reverse conveying rollers 123 grasp the dropping sheet, there is a risk that the rollers 123 fail to grasp the sheet. Therefore, a distance between the pair of forward conveying rollers 122 and the pair of reverse conveying rollers 123 is assured lest the pair of reverse conveying rollers 123 fail to grasp the sheet.

Figure 8D:
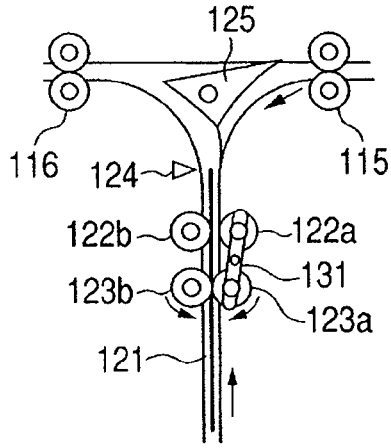

The control part 700 turns on the reverse conveyance clutch 130, thereby starting the rotation of the reverse conveyance touch/detach roller 123*a*. Thus, the pair of reverse conveying rollers 123 reversely convey the sheet (FIG. 8D, S1006).

Since the sheet P1 is reversely conveyed, the portion which has been the rear edge so far becomes the front edge. The pair of reverse conveying rollers 123 convey the sheet. The sheet is guided by the guide member 303 and the flapper 125 and conveyed to the discharge path 302.

When the sheet completely passes through the branch sensor 124 (S1007), the control part 700 turns off the motor 126, reverse conveyance clutch 130, and solenoid 132, and rotates the link 131 in the direction shown by an arrow, thereby returning the pair of forward conveying rollers 122 and the pair of reverse conveying rollers 123 to the initial state (S1008). The forward conveyance clutch 129 has already been turned off in step S1005.

Figure 8E:
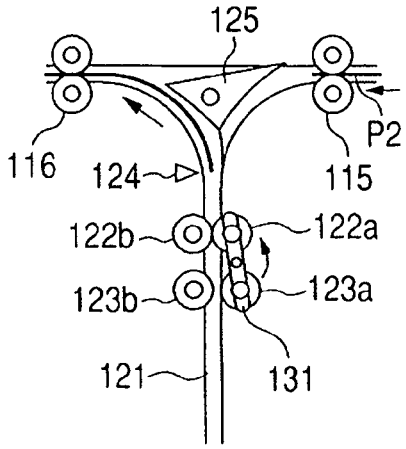

Thus, the pair of forward conveying rollers 122 which have been in the detachment condition so far enter the contact condition, the pair of reverse conveying rollers 123 which have been in the contact condition so far enter the detachment condition, and the sheet reverse conveyance device 310 enters the state where the sheet P2 which is subsequently sent can be reversely conveyed (FIG. 8E).

Figure 8F:
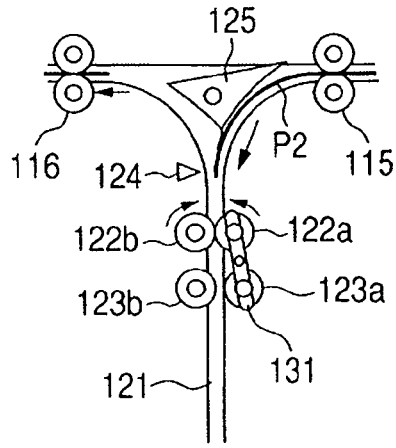

The sheet P1 fed out of the reverse conveyance path 121 is discharged from the printer 100 toward the outside (finisher 500) by the pair of discharging rollers 116. The reverse conveying process is also executed to the next sheet P2 and the front and back sides of the sheet P2 are reversed in a manner similar to the precedent sheet P1 (FIG. 8F). The reversing operation of the sheet reverse conveyance device 310 is executed until there are no more sheets (S1009).

The conventional sheet reverse conveyance device has executed the forward conveyance and the reverse conveyance of the sheet by the pair of rollers. Therefore, since the pair of rollers temporarily enter the stop state when the rotation is changed from the forward rotation to the reverse rotation, the reversing time of hundreds of milliseconds is required. On the other hand, since the sheet reverse conveyance device 310 shown in FIG. 7 executes the forward conveyance and the reverse conveyance of the sheet by the different pairs of the rollers, the sheet can be reversed without stopping one of the pairs of the rollers. Specifically speaking, the necessary reversing time is equal to about 100 msec and is shorter than the conventional one.

That is, since the sheet reverse conveyance device 310 shown in FIG. 7 reverses the sheet by the touch/detach operations of the pair of forward conveying rollers 122 and the pair of reverse conveying rollers 123 by the solenoid 132, the sheet can be reversed irrespective of the acceleration and deceleration of the reverse conveying motor 126. The time necessary to reverse the sheet can be shortened more than the conventional one.

Moreover, in the sheet reverse conveyance device 310 shown in FIG. 7, the rotational force of the reverse conveying motor 126 is transferred to the pair of forward conveying rollers 122 by the forward conveyance clutch 129 and transferred to the pair of reverse conveying rollers 123 by the reverse conveyance clutch 130. Therefore, the transfer of the rotational force to the pair of rollers 122 and the pair of rollers 123 can be turned on and off irrespective of the acceleration and deceleration of the reverse conveying motor 126, so that the sheet can be accurately reversed.

The sheet reverse conveyance device 310 shown in FIG. 7 can execute the reversing process of the sheet in about 100 msec even if response time of the solenoid 132 and the response connecting time of the forward conveyance clutch 129 and the reverse conveyance clutch 130 are included, so that the necessary reversing time can be shortened more than the conventional one.

Further, in the sheet reverse conveyance device 310 shown in FIG. 7, since the link 131 in which the forward conveyance touch/detach roller 122*a* and the reverse conveyance touch/detach roller 123*a* are provided at both ends is inclined by one solenoid 132, the touch/detach operations of both pairs of rollers can be simultaneously and certainly executed by the simple structure.

In the sheet reverse conveyance devices 300 and 310 described above, the pair of forward conveying rollers 122 which rotate in such a direction as to convey the sheet into the reverse conveyance path 121 are provided at the position closer to the entrance of the reverse conveyance path 121 than the pair of reverse conveying rollers 123 which rotate in such a direction as to feed the sheet out of the reverse conveyance path 121. However, such a layout may be also reversed.

In the sheet reverse conveyance devices 300 and 310, since the forward conveyance and the reverse conveyance of the sheet are executed by the different pairs of rollers, a rotational speed of the pair of forward conveying rollers 122 and a rotational speed of the pair of reverse conveying rollers 123 can be also changed by a method of changing a gear ratio for transferring the rotation between the motor 126 and the pair of forward conveying rollers 122 and a gear ratio for transferring the rotation between the motor 126 and the pair of reverse conveying rollers 123, or the like. For example, if the rotational speed of the pair of reverse conveying rollers 123 is set to be higher than that of the pair of forward conveying rollers 122, the sheet can be reversed at the increased speed at the time of the sheet reverse conveyance, so that the sheet reverse conveying process can be rapidly executed.

Further, in the sheet reverse conveyance devices 300 and 310, the sheet can be moved by the inertia while the forward conveyance clutch 129 prevents the rotational force of the motor 126 from being transferred to the pair of forward conveying rollers 122. However, it is also possible to construct the apparatus in such a manner that the pair of forward conveying rollers 122 are set into the detachment condition by the solenoid without providing the forward conveyance clutch 129, thereby enabling the sheet to be moved by the inertia. Therefore, the forward conveyance clutch 129 is not always necessary. If the pair of reverse conveying rollers 123 enter the contact condition and the detachment condition in the rotating state, the time necessary for the sheet reversing operation can be shortened. Therefore, the reverse conveyance clutch 130 is not always necessary.

In the foregoing sheet reverse conveyance devices 300 and 310, the sheet reverse conveying operation is executed on the basis of the detecting operation of the branch sensor 124. However, the sheet reverse conveying operation can be also executed by a combination of sensors (not shown) arranged near the pair of discharging rollers 116, fixing device 105, pair of conveying rollers 115, and the like in place of the branch sensor 124.

A pair of forward conveying belts and a pair of reverse conveying belts may be also used in place of the pair of forward conveying rollers 122 and the pair of reverse conveying rollers 123. The rotation members are not limited to the rollers.

This application claims priority from Japanese Patent Application No. 2005-135304 filed May 6, 2005, which is hereby incorporated by reference herein.

What is claimed is:

1. A sheet reverse conveyance device for temporarily conveying a sheet which has entered a reverse conveyance path from an entry path into said reverse conveyance path, thereafter, conveying the sheet to a discharge path, and reversing the sheet, comprising:

a pair of forward conveyance rotation members which are provided on said reverse conveyance path, rotate in such a direction as to convey the sheet into said reverse conveyance path, and can touch and detach;

a pair of reverse conveyance rotation members which are provided on said reverse conveyance path, rotate in the direction opposite to the rotating direction of said pair of forward conveyance rotation members in order to convey the sheet conveyed into said reverse conveyance path by said pair of forward conveyance rotation members to said discharge path, and can touch and detach; and a control part adapted to control the touch/detach operations of said pair of forward conveyance rotation members and said pair of reverse conveyance rotation members, and to control a rotation of said pair of reverse conveyance rotation members, wherein said control part controls in such a manner that said pair of forward conveyance rotation members are set into a contact condition and said pair of reverse conveyance rotation members are set into a detachment condition until a rear edge of the sheet which has entered said reverse conveyance path and is conveyed by said pair of forward conveyance rotation members passes through an entrance of said discharge path, and in order to convey the sheet to said discharge path by said pair of reverse conveyance rotation members, said pair of forward conveyance rotation members are set into the detachment condition and said pair of reverse conveyance rotation members are set into the contact condition after the rear edge of the sheet conveyed by said pair of forward conveyance rotation members passed through the entrance of said discharge path, and said control part controls so that, after said pair of reverse conveyance rotation members grasp the sheet or at a time when said pair of reverse conveyance rotation members grasp the sheet, said pair of reverse conveyance rotation members start to rotate.

2. A device according to claim 1, further comprising rotation member pair touch/detach means which allows said pair of forward conveyance rotation members and said pair of reverse conveyance rotation members to execute the touch/detach operations and whose operation is controlled by said control part, and wherein said rotation member pair touch/detach means has two operating parts which are provided in correspondence to said pair of forward conveyance rotation members and said pair of reverse conveyance rotation members and set each of said pair of forward conveyance rotation members and said pair of reverse conveyance rotation members into the contact condition and the detachment condition.

3. A device according to claim 1, further comprising rotation member pair touch/detach means which allows said pair of forward conveyance rotation members and said pair of reverse conveyance rotation members to execute the touch/detach operations and whose operation is controlled by said control part, and wherein said rotation member pair touch/detach means has: pivot members which are provided at both ends of one of each of said pair of forward conveyance rotation members and said pair of reverse rotation and in each of which an intermediate portion of said one of each of said pairs of rotation members is set to a rotational center; and an operating part adapted to rotate said pivot members, thereby setting one of said pair of forward conveyance rotation members and said pair of reverse conveyance rotation members into the contact condition and setting the other one into the detachment condition.

4. A device according to claim 1, wherein a sheet conveying speed of said pair of reverse conveyance rotation members is set to be higher than that of said pair of forward conveyance rotation members.

5. A device according to claim 1, wherein said reverse conveyance path is almost vertical, and said pair of forward conveyance rotation members convey the sheet downward and said pair of reverse conveyance rotation members convey the sheet upward.

6. A device according to claim 1, wherein said control part controls so that timing for the detachment of said pair of forward conveyance rotation members and timing for the contact of said pair of reverse conveyance rotation members coincide.

7. An image forming apparatus comprising:

an image forming part adapted to form an image onto a sheet; and a sheet reverse conveyance device according to claim 1 adapted to reverse the sheet on which the image has been formed by said image forming part and convey said sheet.

* * * * *